US009267474B2

(12) United States Patent
Abe et al.

(10) Patent No.: US 9,267,474 B2
(45) Date of Patent: Feb. 23, 2016

(54) IGNITION DEVICE

(71) Applicant: DENSO CORPORATION, Kariya, Aichi-pref. (JP)

(72) Inventors: Yuya Abe, Nagoya (JP); Akimitsu Sugiura, Nagoya (JP); Shinichi Okabe, Aichi-ken (JP)

(73) Assignee: DENSO CORPORATION, Kariya (JP)

( * ) Notice: Subject to any disclaimer, the term of this patent is extended or adjusted under 35 U.S.C. 154(b) by 272 days.

(21) Appl. No.: 13/943,868

(22) Filed: Jul. 17, 2013

(65) Prior Publication Data

US 2014/0026848 A1 Jan. 30, 2014

(30) Foreign Application Priority Data

Jul. 25, 2012 (JP) ..... 2012-164371

(51) Int. Cl.
*F02P 23/04* (2006.01)
*F02M 57/06* (2006.01)

(52) U.S. Cl.
CPC ..... *F02M 57/06* (2013.01); *F02P 23/045* (2013.01)

(58) Field of Classification Search
CPC ..... F02M 57/06; F02P 23/04; F02P 9/007; F02P 23/045
USPC ..... 123/143 B, 297
See application file for complete search history.

(56) References Cited

U.S. PATENT DOCUMENTS 5,469,013 A 11/1995 Kang
7,644,698 B2 * 1/2010 Shiraishi et al. ..... 123/406.19
7,714,488 B2 * 5/2010 Nagasawa et al. ..... 313/130
2009/0031988 A1 2/2009 Shiraishi et al.
2009/0126668 A1 5/2009 Shiraishi et al.
2009/0126684 A1 5/2009 Shiraishi et al.
2012/0104959 A1 5/2012 Kameda et al.
2014/0144402 A1 * 5/2014 Okabe et al. ..... 123/169 EL

FOREIGN PATENT DOCUMENTS

JP 2009-36125 2/2009
JP 2009-121406 6/2009
JP 2010-037949 2/2010
JP 2012-99303 5/2012
JP 2012-127286 7/2012
JP 2014-22341 * 2/2014 ..... F02P 13/00

OTHER PUBLICATIONS

Information Offer Form (5 pages) dated May 12, 2015, issued in corresponding Japanese Application No. 2012-164371 and English translation (3 pages).
Japanese Patent Office, "Notification of Reasons for Rejection," (2 pages) issued in connection with Japanese Patent Application No. 2012-164371, dated Jul. 21, 2015, with its English language Translation (2 pages).

* cited by examiner

*Primary Examiner* — Hai Huynh
(74) *Attorney, Agent, or Firm* — Nixon & Vanderhye P.C.

(57) ABSTRACT

In an ignition device, a base section of a discharge chamber is formed by a part of a central dielectric body. A front section of a ground electrode and a front end section of the central dielectric body are projected toward a combustion chamber of a head cylinder of an internal combustion engine by a predetermined height which is measured from a top ceiling wall of the head cylinder. The predetermined height of the front end section of the central dielectric body projected into the inside of the head cylinder is the same or higher than the predetermined height of the front end section of the ground electrode projected into the inside of the head cylinder. The predetermined height of the front end section of the ground electrode is within a range of 3 mm to 25 mm.

16 Claims, 9 Drawing Sheets

IGNITION DEVICE

CROSS-REFERENCE TO RELATED APPLICATION

This application is related to and claims priority from Japanese Patent Application No. 2012-164371 filed on Jul. 25, 2012, the contents of which are hereby incorporated by reference.

BACKGROUND OF THE INVENTION

1. Field of the Invention

The present invention relates to ignition devices for performing spark ignition of fuel, mounted to an internal combustion engine having characteristics of resistance to ignition.

2. Description of the Related Art

Recently, there have been developed various types of high efficient engines with high performance and low NOx combustion capable of improving fuel consumption and performing carbon dioxide reduction. Because of often having a high boost and compression with a low concentration of fuel mixture gas, such a high efficient engine has a low ignitability (or has characteristics of resistance to ignition), which is difficult to ignite, by a spark. In order to perform combustion with high efficiency in such an internal combustion engine with a low ignitability, i.e. characteristics of resistance to ignition by a spark, it is necessary to provide an ignition device having a rapid combustion speed with a superior ignitability.

A first conventional patent document, Japanese patent laid open publication No. JP 2012-99303 has disclosed an ignition system comprised of an insulation section, a central electrode, a ground electrode, a plasma jet ignition plug, a discharge power source, and an energy supply section. The insulation section has an axial hole extending along an axial direction. The central electrode is inserted and arranged in the axial hole of the insulation section so that a front end section of the central electrode is arranged in an axial direction at a rear side of the front end section of the insulation section. The ground electrode is arranged in front of the front end section of the insulation section. The central electrode and the ground electrode form a gap. The plasma jet ignition plug has a cavity section which is formed by an inner peripheral surface of the axial hole and a front end surface of the central electrode. The discharge power source supplies a voltage to the gap formed between the central electrode and the ground electrode. The energy supplying section supplies electric power to the gap. The discharge power source supplies the voltage to the gap in order to generate spark discharge. Thus, plasma is generated in the cavity section when the discharge power source supplies electric power to the cavity section.

However, because the ignition system disclosed in the first conventional patent document generates high temperature and high pressure plasma as ignition sources in the cavity section, it is difficult to avoid the central electrode and the ground electrode from being damaged and deteriorated. It is therefore difficult for such a conventional ignition system to increase durability thereof for actual use because discharging is repeated with a short time period in an internal combustion engine which uses the ignition system.

In order to avoid such a conventional problem, a second conventional patent document, Japanese patent laid open publication No. JP 2009-121406 has proposed an internal combustion engine equipped with a barrier discharge device capable of generating free radicals, preventing electrode deterioration and improving ignitability. The barrier discharge device is comprised of a first electrode, a second electrode, a dielectric body, and a barrier discharge section. The first electrode is made of conductive material mounted to a cylinder head of a cylinder. The second electrode is arranged to face to the first electrode. The dielectric body is formed on one of the first electrode and the second electrode. When a voltage is supplied between the first electrode and the second electrode, the barrier discharge section generates free radicals in fuel mixture gas in the cylinder before spontaneous ignition by barrier discharge between the dielectric body and the electrode.

The internal combustion engine disclosed in the second conventional patent document generates non-equilibrium plasma by barrier discharge, and generates free radicals in fuel mixture gas in the cylinder of the internal combustion engine before spontaneous ignition in order to improve ignitability without electrode deterioration.

However, it is difficult for the conventional barrier discharge device disclosed in the second conventional patent document to securely ignite fuel gas in the cylinder by non-equilibrium plasma during the entire operation of the internal combustion engine. In particular, in order to more reduce fuel consumption and improve ignitability, a strong gas flow is generated in the combustion chamber of the cylinder in order to forcedly mix air and fuel injected in the combustion chamber. However, the strong gas flow blows off and scatters non-equilibrium plasma in the combustion chamber of the cylinder, and it is difficult to grow flame kernel by a direct reaction between the non-equilibrium plasma and fuel mixture gas.

Still further, because the discharge chamber is formed apart from the combustion chamber to the engine head from in such a conventional barrier discharge device, it is not always to use generated whole non-equilibrium plasma with high efficiency in ignition.

Still further, because the conventional barrier discharge device has a structure in which a base section of the discharge chamber is formed by a part of a housing casing with which the center dielectric body is fixed, the discharge chamber has large cooling capability. The discharge chamber having the above structure causes energy loss. This is a problem.

SUMMARY

It is therefore desired to provide an ignition device having superior ignitability and high durability when the ignition device is mounted to an internal combustion engine even if the ignition device is mounted to an internal combustion engine having characteristics of resistance to ignition. The ignition device is capable of generating non-equilibrium plasma (low temperature plasma) having high electron temperature and low molecular temperature in a discharge chamber when a high frequency voltage within a specified frequency range is supplied to the discharge chamber for a specified period of time. The ignition device generates and quickly grows flame kernel in the discharge chamber by using the generated non-equilibrium plasma, and provides the generated flame kernel to fuel mixture gas in a combustion chamber of the internal combustion engine in order to execute the combustion of the fuel mixture gas.

An exemplary embodiment provides an ignition device mountable to an internal combustion engine having a combustion chamber in which strong flow of fuel gas is generated. The ignition device has a central electrode, a central dielectric body, a housing casing, a ground electrode, a high frequency power source, and a discharge chamber. The central electrode has an elongated shape. The central dielectric body has a cylindrical shape with a base section which covers the central electrode. The housing casing has a cylindrical shape which surrounds the central dielectric body. The ground electrode has a ring shape formed at a front section of the housing casing. The ground electrode is electrically insulated from the central electrode by the central dielectric body. The ground electrode is projected into an inside of the combustion chamber of the internal combustion engine by a predetermined height $H_{120}$. A front end section of the central dielectric body is projected into the inside of the combustion chamber of the internal combustion engine by a predetermined height $H_{110}$ of the central dielectric body. The predetermined height $H_{110}$ is equal or greater than the predetermined height $H_{120}$ of the ground electrode. The high frequency power source supplies a high voltage having a predetermined frequency for a predetermined period of time between the central electrode and the front end section of the ground electrode. The discharge chamber has approximately a cylindrical shape formed between the central dielectric body and the ground electrode. The discharge chamber has a base section formed by at least a part of the central dielectric body. A streamer discharge is executed in the discharge chamber in order to generate non-equilibrium plasma, and reacts the generated non-equilibrium plasma with fuel mixture gas in the discharge chamber, and to ignite the fuel gas in the combustion chamber of the internal combustion engine.

A conductive layer is formed within a predetermined area on a surface of the central dielectric body in order to adhere to the central dielectric body to the housing casing by using elasticity of the conductive layer.

Because the base section of the discharge chamber in the ignition device according to an exemplary embodiment is formed by a part of the central dielectric body, it is possible to prevent flame kernel generated in the discharge chamber from being blown out, and to reduce energy loss as compared with a conventional case in which the base section of the discharge chamber is formed by a part of the housing casing made of metal having a highly thermal conductivity.

Further, because the conductive layer is formed within a predetermined area on a surface of the central dielectric body, it is possible to maintain adhesion between the central dielectric body and the housing casing by using elasticity of the conductive layer, and to prevent occurrence of discharge in the area except the discharge chamber.

Still further, because both the front end section of the ground electrode and the front end section of the central dielectric body are projected into the inside of the combustion chamber of the cylinder head, fuel gas flowing at a high speed in the combustion chamber collides with the ground electrode projected into the combustion chamber when flame kernel is generated by reacting non-equilibrium plasma with the fuel mixture gas in the discharge chamber. This structure makes it possible to suppress the fuel gas flowing at a high speed from blowing off the generated flame kernel by the presence of the front section of the ground electrode projected into the inside of the combustion chamber. Further, it is possible to mix the generated flame kernel with the fuel mixture gas together by using vortex generated in front of the ground electrode, i.e at a downstream side of the ground electrode. This structure provides rapid growth and propagation of generated flame kernel.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
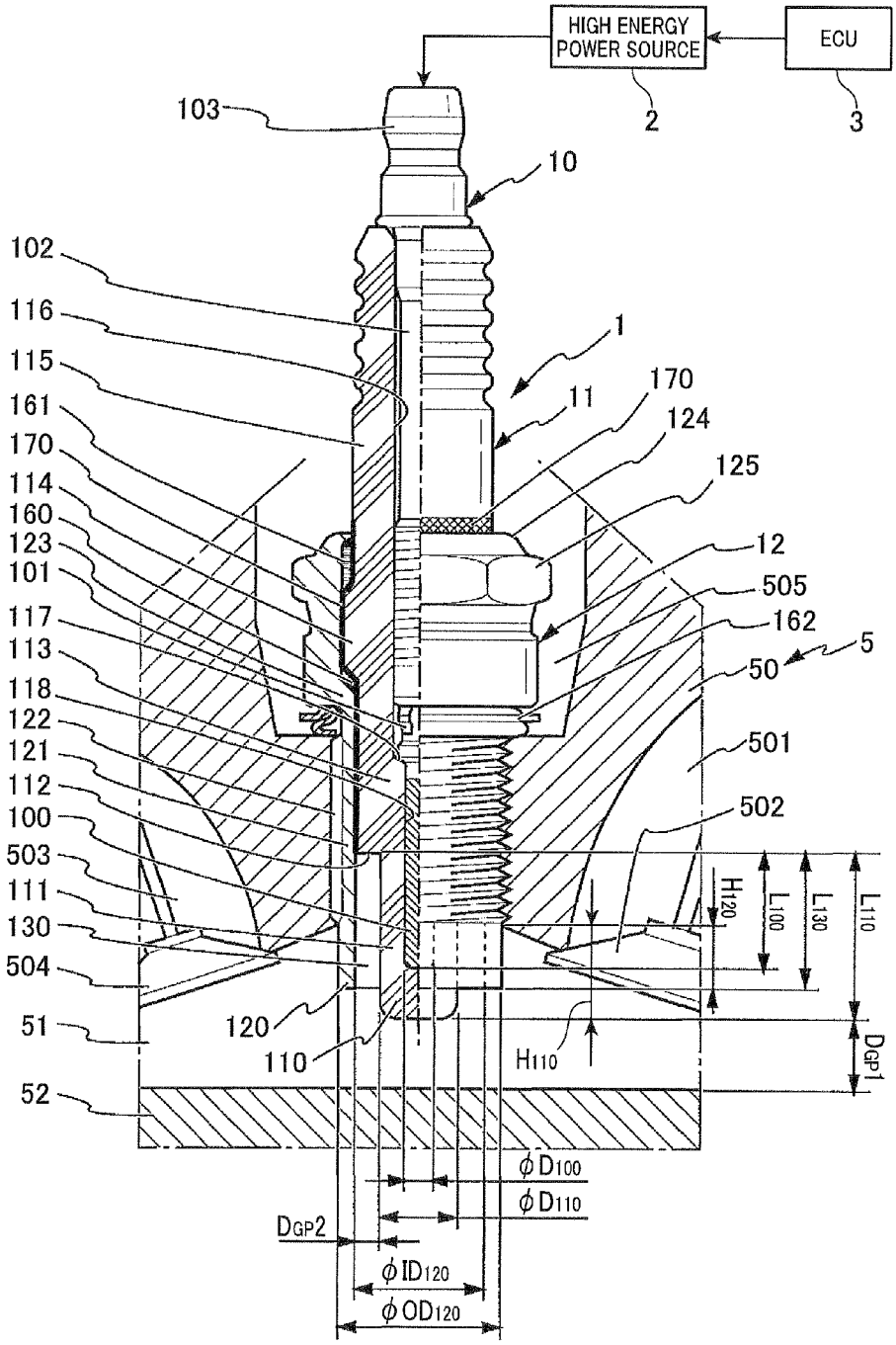
FIG. 1 is a cross section showing a part of an ignition device 1 according to an exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

Exemplary Embodiment

A description will be given of the ignition device according to an exemplary embodiment and modifications with reference to FIG. 1, and FIG. 7A to FIG. 7F.

The ignition device 1 according to the exemplary embodiment has superior ignitability and high durability to be used in various types of internal combustion engines, etc. Those engines have characteristics of resistance to ignition, highly boosting function, highly compression function, highly EGR function, high efficiency and a low NOx production during a lean burn mode.

A description will now be given of a structure of the ignition device 1 according to the exemplary embodiment with reference to FIG. 1. FIG. 1 is a cross section showing a part of an ignition device 1 according to an exemplary embodiment of the present invention.

As shown in FIG. 1, the ignition device 1 is comprised of a central electrode 10 having about a bar shape, a central dielectric body 11, and a housing casing 12 having about a cylindrical shape, i.e. roughly a cylindrical shape. The central dielectric body 11 covers a front end section 100 of the central electrode 10. The central dielectric body 11 has about a cylindrical shape with a base section. A front end section of the central dielectric body 11 is exposed to the outside of the ignition device 1. The housing casing 12 covers the outer periphery of the central dielectric body 11.

An electric control device (ECU) 3 detects the current operation condition of an internal combustion engine 5 and instructs a high energy power source 2 to supply a high energy power having a predetermined frequency (within a range of 15 kHz to 50 MHz) for a predetermined period of time to the ignition device 1 on the basis of the detected operation condition of the internal combustion engine 5. When the high energy power is supplied to the ignition device 1, non-equilibrium plasma is generated at a front end section of the ignition device 1, and initial flame kernel is generated by the reaction of the generated non-equilibrium plasma and fuel mixture gas in a combustion chamber 51 of the internal combustion engine 5.

The central electrode 10 is made of highly electrically conductive material having a shape extending in an axial direction thereof, i.e. an elongated shape. In more detail, the central electrode 10 is comprised of a front section 100 of the central electrode 10, a junction section 101, a stem section 102 and a terminal section 103.

The front section 100 of the central electrode 10 is made of a mixture of nickel alloy having a superior heat resistance function and highly conductive material such as copper. In order to easily produce the central electrode 10, the front section 100 of the central electrode 10 is and the stem section 102 are produced independently. The front section 100 of the central electrode 10 is electrically connected to the stem section 102 through the junction section 101. The terminal section 103 is electrically connected to the high energy power source 2 externally arranged from the ignition device 1.

Figure 2:
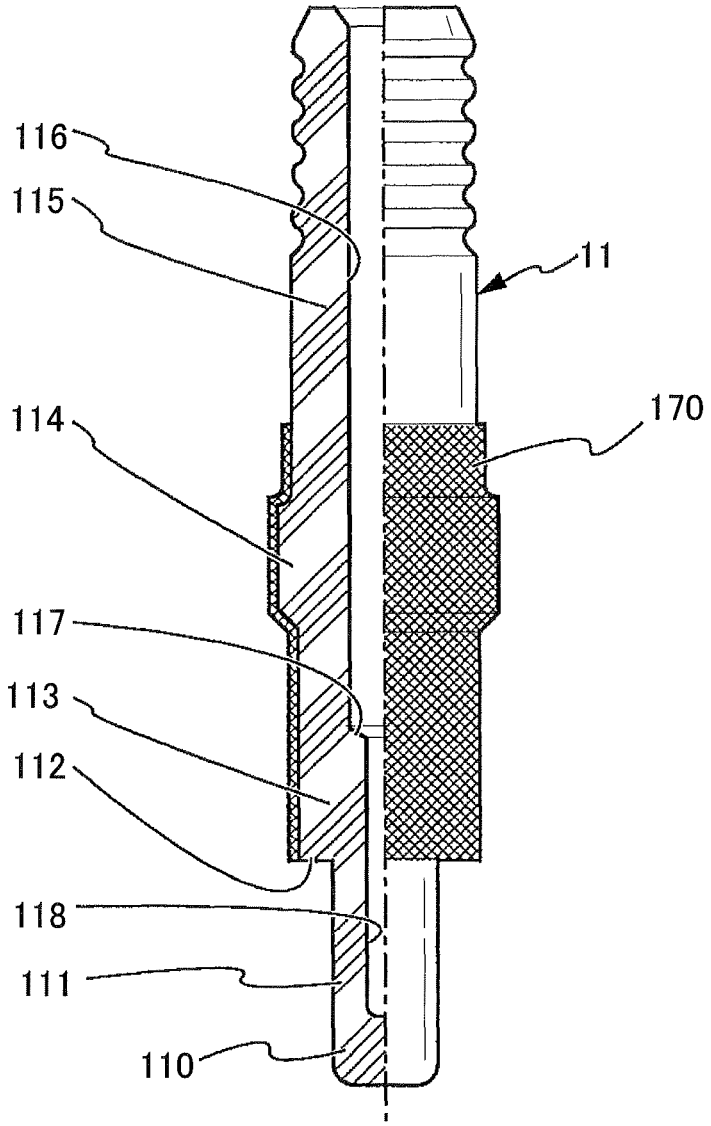
FIG. 2 is a cross section showing a part of a central dielectric body used in the ignition device 1 according to the exemplary embodiment shown in FIG. 1.

FIG. 2 is a cross section showing a part of a central dielectric body 11 in the ignition device 1 according to the exemplary embodiment shown in FIG. 1.

The central dielectric body 11 is made of dielectric material having highly heat resistance function such as alumina, zirconia. The central dielectric body 11 has about a cylindrical shape with the base section. As shown in FIG. 2, the central dielectric body 11 is comprised of a front end section 110, a front end side surface section 111, a base section 112 of the discharge chamber 130, an electrode supporting section 113, an enlarged diameter section 114, a head section 115, central electrode penetration sections 116 and 118, and an electrode lock surface 117. A conductive layer 170 is formed to cover a predetermined area of an outer peripheral surface of the central dielectric body 11. The conductive layer 170 is formed on the outer peripheral surface of the central dielectric body 11 by using known methods, for example, conductive film printing, plating, metal foil pasting, chemical vapor deposition (CVD), physical vapor deposition (PVD), etc.

The front end section 110 of the central dielectric body 11 is arranged in the inside of a combustion chamber 51 of the internal combustion engine 5 so that a top surface of the front end section 110 projects toward the inside of the combustion chamber 51 and a predetermined length of the front end section 110 of the central dielectric body 11 is exposed in the inside of the combustion chamber 51. A concrete structure of the front end section 110 of the central dielectric body 11 which faces to the combustion chamber 51 will be explained later.

A discharge chamber 130 is formed between the central dielectric body 11 and the housing casing 12. In more detail, as shown in FIG. 2, the discharge chamber 130 is formed between the front end side surface section 111 of the central dielectric body 11 and the base section 112 of the discharge chamber 130. That is, the base section 112 of the discharge chamber 130 faces to the front end section of the central dielectric body 11.

The enlarged diameter section 114 is formed to enlarge the diameter of the central dielectric body 11 toward an outer diameter direction. The ignition device 1 is fixed to the internal combustion engine 5 by fastening the housing casing 12 in a vertical direction through a sealing member having about a ring shape. That is, as shown in FIG. 1, a predetermined area including the enlarged diameter section 114 is tightly fixed to the inner peripheral surface of the housing casing 12 by using elasticity of a conductive layer 170.

Seal members 160 and 161 are made of known seal member such as metal seals and molded powder. The metal seal has a ring shape. The molded powder is made of talc, etc. and has an approximately cylindrical shape. The seal members 160 and 161 provide airtightness for the discharge chamber 130.

The head section 115 of the central dielectric section 11 is exposed to the outside from the distal end section of the housing casing 12. The head section 115 of the central dielectric section 11 is electrically insulated from the central electrode 10 in order to avoid occurrence of discharge between the terminal section 103 of the central electrode 10 and the housing casing 12. It is possible for the head section 115 of the central dielectric body 11 to have a corrugated shape as an uneven shape in which convex parts and concave parts are alternately formed. This makes it possible to elongate the length and area of the insulation section. That is, this structure makes it possible to prevent occurrence of discharge between the terminal section 103 of the central electrode 10 and the housing casing 12. The central electrode 10 having an elongated shape is inserted into the inside of the central electrode penetration sections 116 and 118, and the junction section 101 of the central electrode 10 is locked by and fixed to the electrode lock surface 117.

The housing casing 12 has about a cylindrical shape and made of known metal materials, iron, nickel, stainless, or etc.

The housing casing 12 is comprised of a front end section of a ground electrode 120, a cylindrical shaped section 121, a screw section 122, a lock section 123, a fastening section 124, a hexagonal shaped section 125, etc. The front end section of the ground electrode 120 has about a ring shape. A part having a predetermined length of the front end section of the ground electrode 120 is exposed to the inside of the combustion chamber 51. The discharge chamber 130 is formed between the cylindrical shaped section 121 and the central dielectric body 11. The ignition device 1 is fixed to a cylinder head section 50 of the internal combustion engine 5 by the screw section 122. The lock section 123 supports the enlarged diameter section 114 of the central dielectric body 11. The enlarged diameter section 114 of the central dielectric body 11 is fastened by and fixed to the fastening section 124 through the seal members 160 and 161. The screw section is fastened by the hexagonal shaped section 125.

Because the ignition device 1 according to the exemplary embodiment having the structure previously described does not generate thermal plasma during discharging, it is difficult to deteriorate the electrodes, and it is not always necessary to use specific materials having superior heat resistance, for example iridium, etc. That is, it is sufficient to select and use usual materials to produce general spark plugs.

The ignition device 1 according to the exemplary embodiment has the following structural relationship.

As shown in FIG. 1, the central electrode 10 has a length $L_{100}$, the front end section of the central dielectric body 11 has a length $L_{110}$, and the discharge chamber 130 has a length $L_{130}$. The length $L_{100}$, of the central electrode 10 and the length $L_{130}$ of the central dielectric body 11 are measured from the base section 112 of the discharge chamber 130, i.e. from the front end section of the central dielectric body 11 which faces to the discharge chamber 130.

Further, the ground electrode 120 has a height $H_{120}$ which is a distance between a ceiling inner wall of the combustion chamber 51 of the cylinder head section 50 and a top surface of the front end section of the ground electrode 120. The top surface of the front end section of the ground electrode 120 is projected into the inside of the combustion chamber 51. The front end section of the central dielectric body 11 has a height $H_{110}$ which is a distance between the ceiling inner wall of the combustion chamber 51 of the cylinder head section 50 and a top surface of the front end section of the central dielectric body 11. The top surface of the front end section of the central dielectric body 11 is projected into the inside of the combustion chamber 51. FIG. 1 shows the height $H_{120}$ of the ground electrode 120 and the height $H_{110}$ of the central dielectric body 11.

In particular, it is preferable for the front end section of the ground electrode 120 to have the height $H_{120}$ at least within a range of 3 mm to 25 mm, i.e. not less than 3 mm and not more than 25 mm.

Still further, it is preferable for the front end section of the central dielectric body 11 to have a height $H_{110}$ which is at least the same of or not less than the height $H_{120}$ of the ground electrode 120.

When the front end section of the ground electrode 120, which is projected to the inside of the combustion chamber 51, has the height $H_{120}$ of less than 3 mm, it becomes difficult to make fuel gas flow weak in the combustion chamber 51 of the cylinder head section 50 of the internal combustion engine 5. In this case, when the fuel gas flow is passing through an opening section of the front end section of the ground electrode 120, a strong intake force is generated, and the generated strong intake flow blows off an initial flame kernel. This deteriorates the ignition effect of the ignition device 1 according to the exemplary embodiment.

On the other hand, when the front end section of the ground electrode 120, which is projected into the inside of the combustion chamber 51, has the height $H_{120}$ of more than 25 mm, this promote and guide the fuel gas flow toward the front end section of the ignition device 1, and to increase suction force of non-equilibrium plasma generated in the discharge chamber 130 from the discharge chamber 130 to the inside of the combustion chamber 51 of the cylinder head section 50. Then, this phenomenon decreases the function of ignitability.

Further, when the height $H_{110}$ of the front end section of the central dielectric body 11 is not less than a predetermined value, this structure shortens an interval $D_{GP1}$ between a top surface of the piston 52 and the top surface of the front end section 110 of the central dielectric body 11. This has a possibility of allowing discharge between the front end section 110 of the central dielectric body 11 and the piston 52 because of generating strong flow of fuel gas between them. This disperses generated non-equilibrium plasma in the combustion chamber before a flame kernel is generated by the non-equilibrium plasma.

In order to avoid this phenomenon, it is preferable to determine the height $H_{110}$ of the front end section of the central dielectric body 11 so that the distance $D_{GP1}$ is more than a distance $D_{GP2}$, where the distance $D_{GP1}$ is measured from the top surface of the front end section 110 of the central dielectric body 11 and the top surface of the piston 52 at the top dead center, and the distance $D_{GP2}$ is measured from the top surface of the front end section 110 of the central dielectric body 11 and the front end section of the ground electrode 120. That is, the distance $D_{GP2}$, can be expressed by the following equation:

$$D_{GP2}=(\phi ID_{120}-\phi ID_{110})/2,$$

where $\phi ID_{120}$ indicates an inner diameter of the ground electrode, and $\phi ID_{110}$ indicates an outer diameter of the central dielectric body 11.

By the way, when the height $H_{120}$ of the front end section of the ground electrode 120, which is projected to the inside of the combustion chamber 51, is more than the height $H_{110}$ of the front end section of the central dielectric body 11, electric fields are concentrated around the top surface of the front end section 100 of the central electrode 10, and this destroys the electrical insulation of the central dielectric body 11, and as a result there is a possibility of generating arc discharge between the front end section of the ground electrode 120 and the front end section 100 of the central electrode 10.

In order to avoid any generation of the arc discharge between the front end section of the ground electrode 120 and the front end section 100 of the central electrode 10, it is preferable to satisfy a relationship in which the length $L_{100}$ of the front end section of the central dielectric body 11 is less than the length $L_{130}$ of the discharge chamber 130. This structure makes it possible to concentrate the electric fields at the top of the front end section of the central electrode 100, and to easily generate discharge around the opening section at the front end section of the ground electrode 120. In addition to this relationship, it is preferable to satisfy a relationship of $H_{110}(L_{110})>H_{120}$ in which the front end section of the central dielectric body 11 is longer than the front end section of the ground electrode 120, and the front end section of the central dielectric body 11 is closer to the piston 52 than the front end section of the ground electrode 120. Still further, the relationship of $H_{110}(L_{110})>H_{120}$ and the length $L_{100}$ of the front end section 110 of the central dielectric body 11 and the height $H_{120}$ of the front end section of the ground electrode 120 are determined to avoid the electrical insulation of the front end section 110 of the central dielectric body 11 from being destroyed.

Further, as shown in FIG. 1, the ignition device 1 according to the exemplary embodiment has the structure in which the length $L_{130}$ of the discharge chamber 130 is not more than 10 mm, where the length $L_{130}$ of the discharge chamber 130 is measured from the front end section of the ground electrode 120 to the base section 112 of the discharge chamber 130, i.e. to the front section of the central dielectric body 11. This structure of the ignition device 1 makes it possible to ignite a fuel gas mixture in the combustion chamber 51 by using the generated non-equilibrium plasma generated in the discharge chamber 130 with high efficiency because of optionally limiting and using the length $L_{130}$ of the discharge chamber 130.

Because the ground electrode 120 limits the fuel gas flow in the combustion chamber 51, suction force to suck out flame kernel generated in the discharge chamber 130 toward the inside of the combustion chamber 130 becomes weak. Accordingly, if the length $L_{130}$ of the discharge chamber 130 exceeds 10 mm which is out from the optimum range of the length $L_{130}$ of the discharge chamber 130 defined by the present invention, it is difficult to use for ignition non-equilibrium plasma generated at the inside of the discharge chamber 130, i.e. at a deep section which is a side of the base section 112 of the discharge chamber 130 facing the front end section of the central dielectric body 11. This causes energy loss during ignition and combustion.

The ignition device 1 according to the exemplary embodiment has the structure in which the top surface of the front end section of the central dielectric body 11 has a flat shape, and an outer periphery of the front end section of the central dielectric body 11 has a rounded shape. This structure makes it possible to prevent arc discharge from being generated between the front end section 110 of the dielectric body 11 and the front end section of the ground electrode 120, to introduce streamer discharge in an area near to the opening section of the front end section of the ground electrode 120, and to speedily react the fuel mixture gas and the streamer discharge, where the opening section of the front end section of the ground electrode 120 closes to the combustion chamber 50 of the cylinder head 50.

On the other hand, because a top part of a front end section of a central dielectric body in a conventional ignition device has a sphere surface, streamer discharge is easily generated at a deep section of an area between the outer peripheral surface of the front end section of the central dielectric body and a front end section of an ground electrode although this structure prevents generation of arc discharge. This causes discharge energy loss near a base section of a discharge chamber.

The ignition device 1 according to the exemplary embodiment uses the high energy power source 2 which supplies high energy power such as a high frequency voltage within a frequency range of 15 kHz to 50 MHz. When receiving the high frequency voltage within a frequency range of 15 kHz to 50 MHz supplied from the high energy power source 2, the ignition device 1 generate non-equilibrium plasma without generating any thermal plasma.

When the high energy power source 2 supplies power to the ignition device 1 energy having a predetermined frequency, i.e., a high frequency voltage, non-equilibrium plasma is generated in the discharge chamber 130 in the ignition device 1, and the generated non-equilibrium plasma reacts directly with fuel mixture gas introduced into the discharge chamber 130 in order to generate initial flame kernel. In this case, because the base section 112 of the discharge chamber 130 is formed by a part of the central dielectric body 11, this makes it possible to suppress cold thermal loss as compared with a case in which the end section of the discharge chamber is made of metal.

Further, the conductive layer 170 is formed to cover a predetermined area of the outer peripheral surface of the central dielectric body 11 in which the central dielectric body 11 is supported by the housing casing 12 and the surface of the central dielectric body 11 and the inner peripheral surface of the housing casing 12 are adhered together through the conductive layer 170. When the high energy power source 2 supplies the high frequency voltage between the central electrode 10 and the housing casing 12, this structure makes it possible to prevent discharge from being occurred in the areas excepting the surface of the central dielectric body 11 and the surface of the housing casing 12 which face to the discharge chamber 130. This can suppress energy loss of the ignition device 1.

Still further, because the front end section of the ground electrode 120 is projected into the inside of the combustion chamber 51, fuel gas flowing in the combustion chamber 51 does not blow off the generated flame kernel, and the generated flame kernel is maintained at the front end section of the ignition device 1. This promotes the combustion of the fuel gas and fresh air introduced in the combustion chamber. This structure makes it possible to guarantee a stable growth of the generated flame kernel and to realize a stable ignition for the internal combustion engine having characteristics of resistance to ignition.

In summary, the ignition device 1 according to the exemplary embodiment having the structure previously described has the following effects (A), (B) and (C).

(A) It is possible to prevent flame kernel generated in the discharge chamber 130 from being blown out, and to reduce energy loss;

(B) The conductive layer 170 is formed within a predetermined area on a surface of the central dielectric body 11, i.e. between the central dielectric body 11 and the housing casing 12. This structure makes it possible to maintain the adhesion between the central dielectric body 11 and the housing casing 12 by using elasticity of the conductive layer, and to prevent occurrence of discharge from being generated in the area other than the discharge chamber; and (C) The front end section of the ground electrode 120 and the front end section of the central dielectric body 11 are projected into the inside of the combustion chamber 51 of the cylinder head 50. This structure makes it possible to suppress fuel gas flowing at a high speed in the discharge chamber 130 by the presence of the front section of the ground electrode 120, and to avoid flame kernel generated in the discharge chamber 130 from being blown out by the fuel gas flowing at a high speed. Further, this makes it possible to mix the generated flame kernel and the fuel mixture gas together by using vortex generated in front of the ground electrode 120, i.e. at a downstream side of the ground electrode 120. This structure makes it possible to provide a rapid growth and propagation of generated flame kernel in the discharge chamber 130.

A description will now be given of an internal combustion engine which uses the ignition device 1 according to the exemplary embodiment previously described.

Such an internal combustion engine is a known comprised of at least a reciprocating engine comprised of a cylindrical shaped cylinder (omitted from drawings), the cylinder head 50 which covers the cylindrical shaped cylinder, an intake section 501, an intake valve 502, an exhaust section 503, and an exhaust valve 504. The intake section 501 makes the combustion chamber 51 at the top surface of the piston 52 which is supported to move vertically in the cylinder. The intake valve 502 opens and closes the intake section 501. The exhaust valve 504 opens and closes the exhaust section 503.

The ECU 3 calculates engine load of the internal combustion engine on the basis of a pressure detected by an intake air pressure sensor (not shown). The ECU 3 further calculates a rotation speed transmitted from a rotary angle and a sensor (not shown) and a combustion cycle of the internal combustion engine on the basis of the calculated rotation speed of the internal combustion engine. The ECU 3 instructs a fuel injection valve to inject a predetermined amount of fuel injection at a predetermined timing, and instructs the high energy power source 2 to supply a predetermined high frequency voltage having a predetermined high frequency wave at a predetermined timing in order to generate non-equilibrium plasma in the discharge chamber 130. As a result, this ignites fuel mixture gas in the combustion chamber 51.

Still further, the internal combustion engines using the ignition device 1 according to the exemplary embodiment can use various types of fuel, gasoline, diesel fuel, gas fuel, and etc.

First Comparative Example

A description will now be given of a first conventional ignition device 1z as a first comparative example with reference to FIG. 3.

Figure 3:
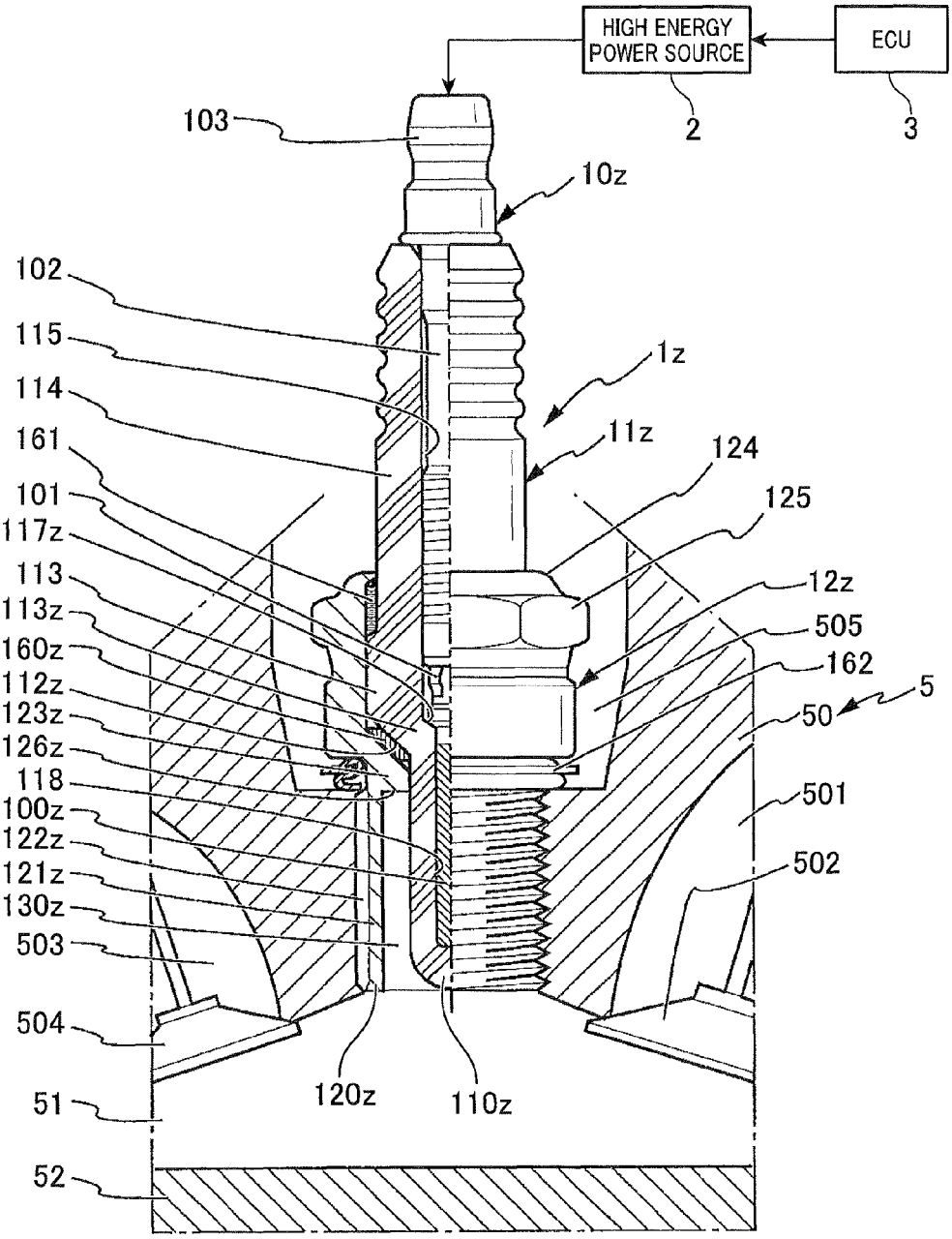
FIG. 3 is a cross section showing a part of a conventional ignition device 1*z* as a first comparative example.

FIG. 3 is a cross section showing a part of the first conventional ignition device 1z as the first comparative example.

The first conventional ignition device 1z is the conventional device disclosed in the first conventional patent document and has a structure in which an electrode supporting section 113z of a central dielectric body 11z is supported and locked by a lock section 123z of a housing casing 12z through a seal member 160z. Further, a front end section of the lock section 123z forms a base section 126z in the discharge chamber 130z. Further, because both a front end section 110z of the central dielectric body 11z and the front end section of the ground electrode 120z are arranged approximately to make a flat surface with the inner wall surface of the cylinder head 50 in the conventional ignition device 1z. That is, as clearly understood from FIG. 3, the conventional ignition device 1z has a structure in which both the front end section 110z of the central dielectric body 11z and the front end section of the ground electrode 120z do not project into the inside of the combustion chamber 51.

Still further, a length of the discharge chamber 130z in the conventional ignition device 1z is significantly longer than the length $L_{130}$ of the discharge chamber in the ignition device 1 according to the exemplary embodiment. When the high energy power source 2 supplies a high frequency voltage having a predetermined frequency to the conventional ignition device 1z, streamer discharge is generated in the discharge chamber 130z and non-equilibrium plasma is thereby generated. At this time, flame kernel is generated by reaction of fuel mixture gas in the discharge chamber 130z. However, because the base section 126z of the discharge chamber 130z is formed by a part of the housing casing 12z in the conventional ignition device 1z. This structure increases cooling thermal loss because the base section 126z of the discharge chamber 130z is a part of the housing casing 12z made of highly conductive metal having highly thermal conductive characteristics as compared with the base section 112 of the discharge chamber 130 which is formed by a part of the central dielectric body 11 in the ignition device 1 according to the exemplary embodiment shown in FIG. 1.

Still further, when fuel gas is passing through the surface of the front end section of the ground electrode 120z, non-equilibrium plasma is significantly sucked out into the inside of the combustion chamber 51 and as a result the non-equilibrium plasma is dispersed into an area in the combustion chamber 51, which is far from the front end section of the ignition device 1z, before the flame kernel is generated by the reaction of the generated non-equilibrium plasma and fuel mixture gas.

Accordingly, there is no occurrence of volume ignition by a direct reaction between the non-equilibrium plasma and fuel mixture gas in the conventional ignition device 1z as the first comparative example. Accordingly, the conventional ignition device 1z uses non-equilibrium plasma as ignition promotion material only in order to improve combustion initiation by using compression ignition or spark ignition.

Second Comparative Example

A description will now be given of a second conventional ignition device 1y as a second comparison example with reference to FIG. 4.

Figure 4:
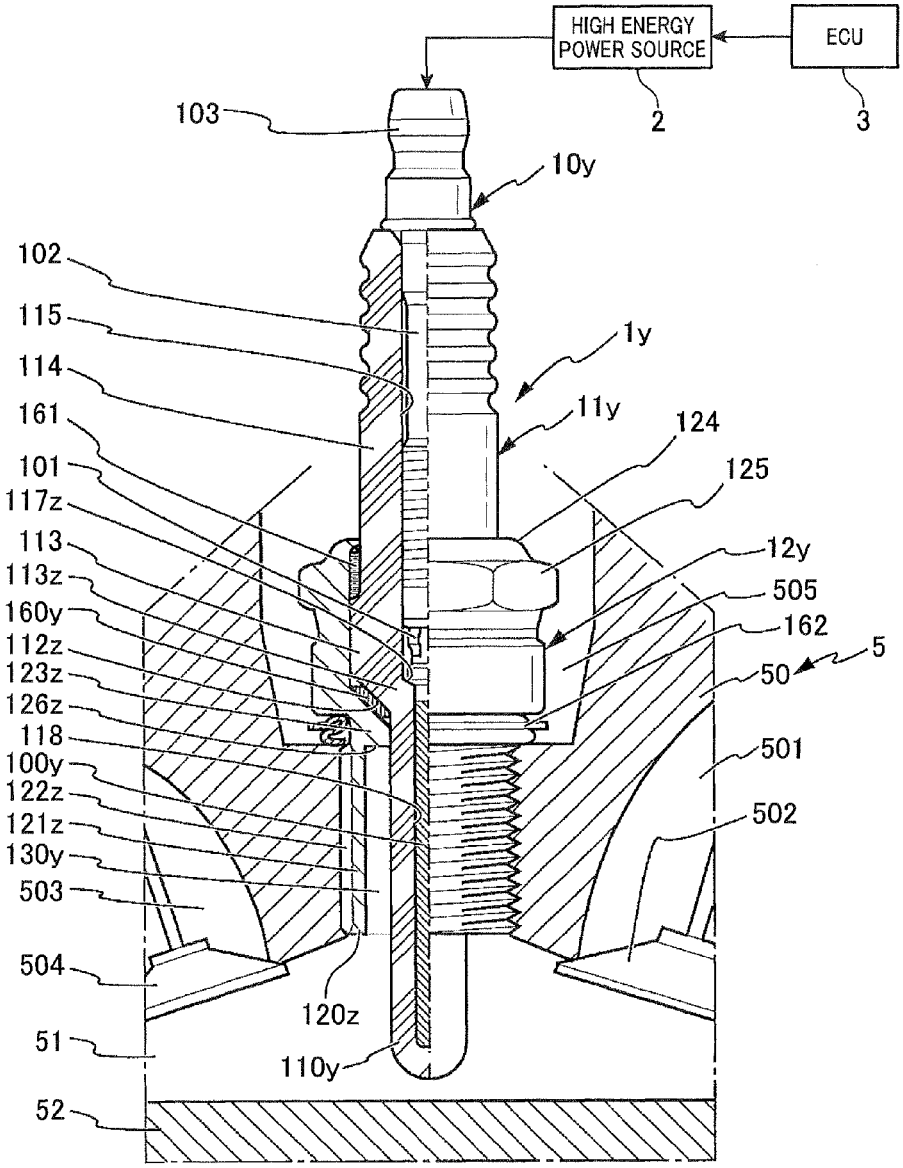
FIG. 4 is a cross section showing a part of a conventional ignition device 1*y* as a second comparative example.

FIG. 4 is a cross section showing a part of the conventional ignition device 1y as the second comparative example.

In a structure of the second conventional ignition device 1y shown in FIG. 4, a front section 110y of the central dielectric body 11y is projected into the inside of the combustion chamber 51, which is different from the structure of the first conventional ignition device 1z shown in FIG. 3. By the way, the base section 126z of the discharge chamber 130y is a part of the housing casing 12y, i.e. made of material which forms the housing casing 12y. A top surface of the front end section of the ground electrode 120z and an inner peripheral surface of the cylinder head 50 make approximately the same surface, like the structure of the first conventional ignition device 1z shown in FIG. 3.

In the structure of the second conventional ignition device 1y shown in FIG. 4, fuel gas flow collides with the front end section 110y of the central dielectric body 110y, and the fuel gas is then flowing along a longitudinal direction of the front end section 110y of the central dielectric body 110y. As a result, a vortex is generated at a downstream side of the front end section 110y of the central dielectric body 11y.

However, because the fuel gas is flowing in the combustion chamber 51 and collides with the front end section 110y of the central dielectric body 110y, the fuel gas becomes a strong gas flow and is flowing at a high speed along a longitudinal direction of the front end section 110y of the central dielectric body 110y. Furthermore, vortex is thereby generated, and the generated vortex of the fuel gas generates strong suction force because the generated vortex affects directly the inside of the discharge chamber 130y. As a result, non-equilibrium plasma generated in the inside of the discharge chamber 130y is strongly sucked out into the inside of the combustion chamber 51. Thus, because the generated non-equilibrium plasma is ejected from the inside of the discharge chamber 130y, this does not promote the growth of flame kernel in the discharge chamber 130y.

Third Comparative Example

A description will now be given of a conventional ignition device 1x as a third comparison example with reference to FIG. 5.

Figure 5:
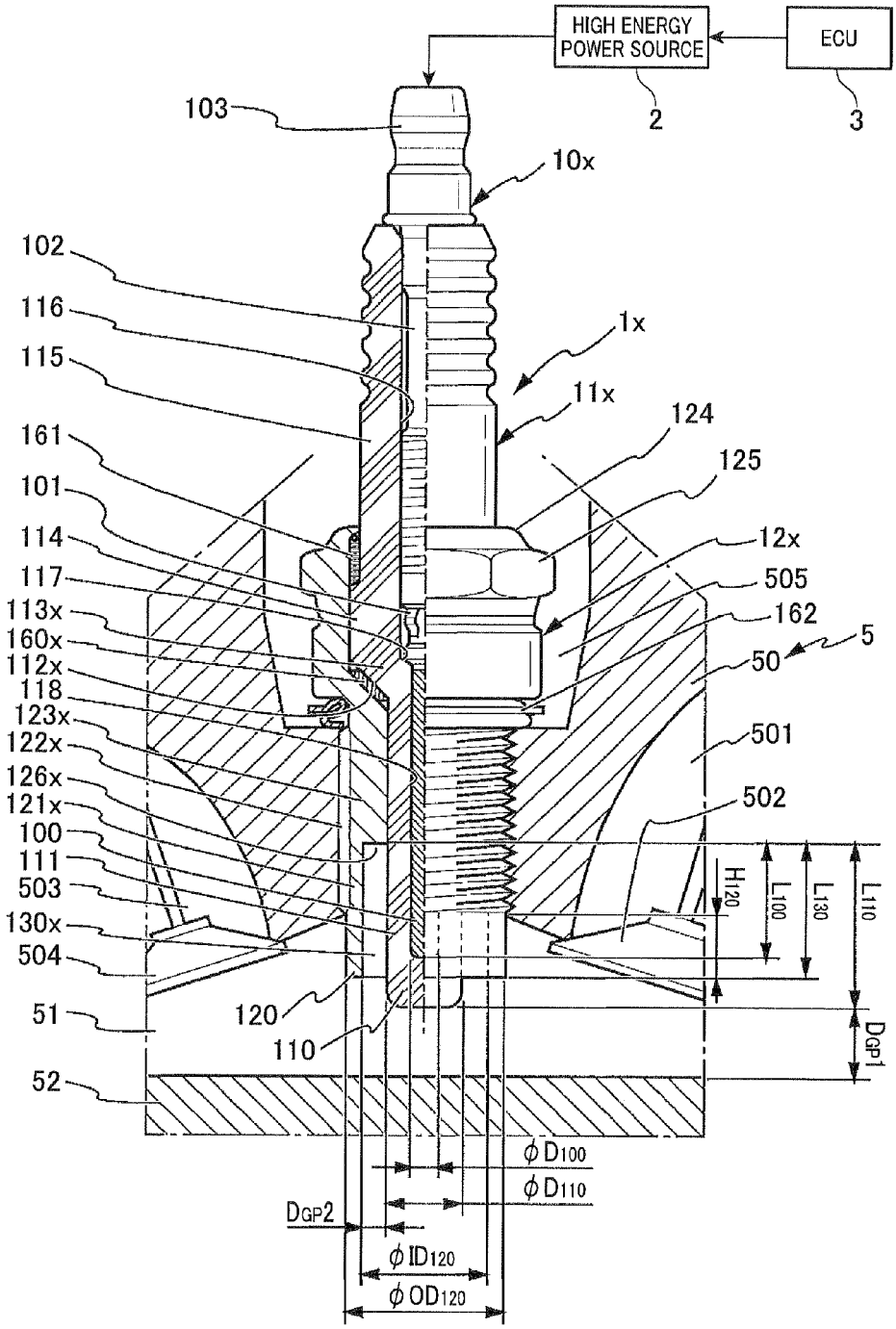
FIG. 5 is a cross section showing a part of a conventional ignition device 1*x* as a third comparative example.

FIG. 5 is a cross section showing a part of the conventional ignition device 1x as the third comparative example.

In a structure of the third conventional ignition device 1x shown in FIG. 5, a front end section 110 of the central dielectric body 11x and the front end section of the ground electrode 120 are projected into the inside of the combustion chamber 51 of the cylinder head 50. In order to decrease a volume of a discharge chamber 130x, a base section 126x of the discharge chamber 130x is formed of a part of the housing casing 12x made of metal. That is, the base section 126x of the discharge chamber 130x is a part of the housing casing 12x, i.e. a front section of the housing casing 12x.

As a result, this structure shown in FIG. 5 makes it possible to suppress fuel gas flowing in the inside of the combustion chamber 51, and to directly react generated non-equilibrium plasma with fuel mixture gas in the discharge chamber 130x, and to execute volume ignition in the discharge chamber 130x. However, because a phenomenon of thermal suction is caused at the base section 126x of the discharge chamber 130x, i.e., at the front section of the housing casing 12x, this structure provides a slow growth of flame kernel in the discharge chamber 130x.

(Experimental Results)

A description will now be given of the effects and characteristics of the ignition device 1 according to the exemplary embodiment with reference to FIG. 6.

Figure 6:
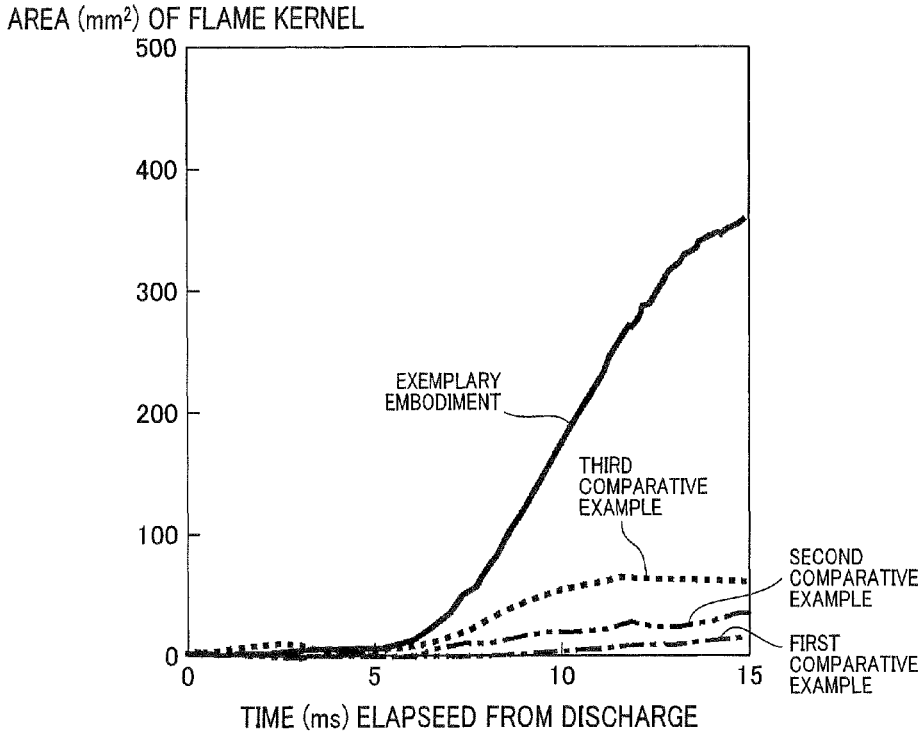
FIG. 6 is a view showing experimental results regarding differences in effects and characteristics of the ignition device between the exemplary embodiment of the present invention and the first to third comparative examples.

FIG. 6 is a view showing experimental results regarding differences in effects and characteristics of the ignition device between the exemplary embodiment shown in FIG. 1 and the first to third comparative examples shown in FIG. 3, FIG. 4 and FIG. 5.

During an engine bench test, fuel gas having a flow speed of 10 m/s was flowing in a cylinder, and the conditions of propagation and growth of flame kernel after discharging were photographed by using a camera. The propagation and growth of flame kernel were generated in the ignition device of the exemplary embodiment and the first to third comparative examples.

FIG. 6 shows a change of an area of the generated flame kernel according to the time elapse. In order to clearly show a combustion speed, the engine bench test used lower temperature and pressure in the combustion chamber rather than temperature and pressure which are actually used in combustion condition of a usual internal combustion engine.

As the experimental results, flame kernel was quickly generated in the discharge chamber of the ignition device 1 according to the exemplary embodiment as compared with other first to third comparative examples.

On the other hand, although volume ignition was generated by non-equilibrium plasma in the third comparative example, the growth speed of flame kernel was lower than that of the exemplary embodiment. Further, the first and second comparative examples had unstable ignition, i.e. did not execute volume ignition by using non-equilibrium plasma.

(Various Modifications)

A description will now be given of first to sixth modifications of the ignition device 1 according to the exemplary embodiment with reference to FIG. 7A to FIG. 7F.

In each of the first to sixth modifications, the end section 112 of the discharge chamber 130*a* is formed by a part of the central dielectric body 11, like the structure of the ignition device 1 according to the exemplary embodiment. This structure of the ignition device as the first to sixth modifications makes it possible to obtain the same effects (A), (B) and (C) of the ignition device 1 according to the exemplary embodiment. The effects (A), (B) and (C) are as follows:

(A) It is possible to prevent a flame kernel generated in the discharge chamber from being blown out, and to reduce energy loss;

(B) The conductive layer 170 is formed within a predetermined area on a surface of the central dielectric body 11, i.e. between the central dielectric body 11 and the housing casing. This structure makes it possible to maintain the adhesion between the central dielectric body 11 and the housing casing by using the elasticity of the conductive layer, and to prevent discharges from being generated in the area other than the discharge chamber; and (C) The front end section of the ground electrode 120 and the front end section of the central dielectric body 11 are projected into the inside of the combustion chamber 51 of the cylinder head 50. This structure makes it possible to suppress fuel gas flowing at a high speed in the discharge chamber by the presence of the front section of the ground electrode 120, and to avoid the flame kernel generated in the discharge chamber from being blown out by the fuel gas flowing at a high speed. Further, this makes it possible to mix the generated flame kernel and the fuel mixture gas together by using vortex generated in front of the ground electrode 120, i.e. at a downstream side of the ground electrode 120. This structure makes it possible to provide a rapid growth and propagation of generated flame kernel in the discharge chamber.

Figure 7A:
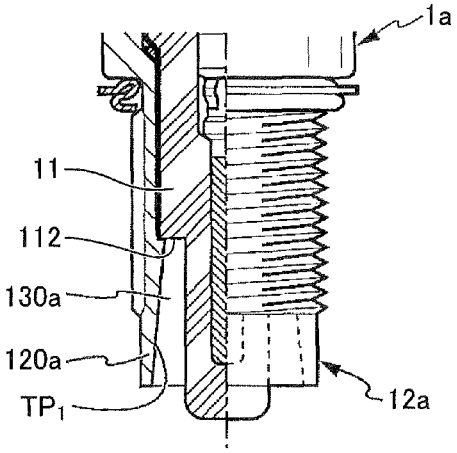
FIG. 7A is a cross section showing a part of an ignition device 1*a* as a first modification of the ignition device 1 according to the exemplary embodiment of the present invention.

FIG. 7A is a cross section showing a part of the ignition device 1*a* as the first modification of the ignition device 1 according to the exemplary embodiment.

In the structure of the ignition device is as the first modification of the embodiment shown in FIG. 7A, the discharge chamber 130*a* has an inclined plane $TP_1$. That is, a diameter of the discharge chamber 130*a* is gradually increased from the base section 112 to the front section of the discharge chamber 130*a*. That is, the discharge chamber 130*a* has a tapered shape from the front section to the base section 112 of the discharge chamber 130*a* shown in FIG. 7A. The volume (or the cross sectional area) of the discharge chamber 130*a* is gradually increased from the base section 112 to the front section of the discharge chamber 130*a*. This structure makes it possible to easily mix a flame kernel generated in the discharge chamber 130*a* with fuel mixture gas, and as a result to achieve a rapid growth of the generated flame kernel.

Figure 7B:
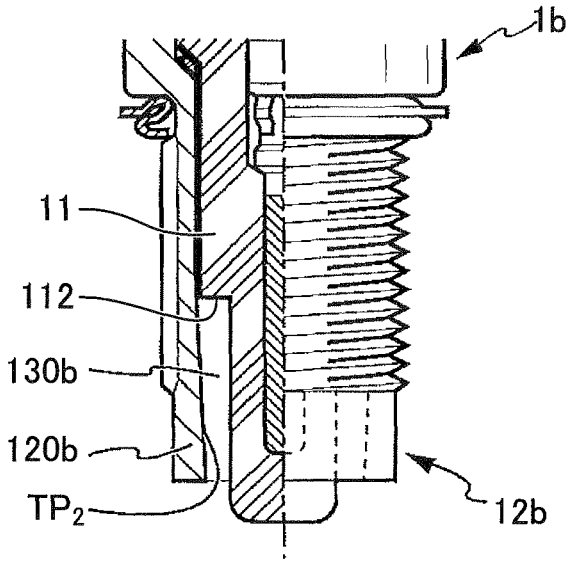
FIG. 7B is a cross section showing a part of an ignition device 1*b* as a second modification of the ignition device 1 according to the exemplary embodiment of the present invention.

FIG. 7B is a cross section showing a part of an ignition device 1*b* as a second modification of the ignition device 1 according to the exemplary embodiment.

In the structure of the ignition device 1*b* as the second modification of the embodiment shown in FIG. 7B, the discharge chamber 130*b* has a tapered surface $TP_2$. That is, a diameter of the discharge chamber 130*b* is gradually decreased from the base section 112 to the front section of the discharge chamber 130*b*. That is, the discharge chamber 130*a* has a tapered shape from the base section 112 to the front section of the discharge chamber 130*b* shown in FIG. 7B. The volume (or the cross sectional area) of the discharge chamber 130*b* is gradually decreased from the base section 112 to the front section of the discharge chamber 130*b*. This structure makes it possible to further prevent flame kernels generated in the discharge chamber 130*b* from being blown out by fuel gas. As a result it is possible to achieve a rapid growth of the flame kernel generated in the discharge chamber 130*b*.

Figure 7C:
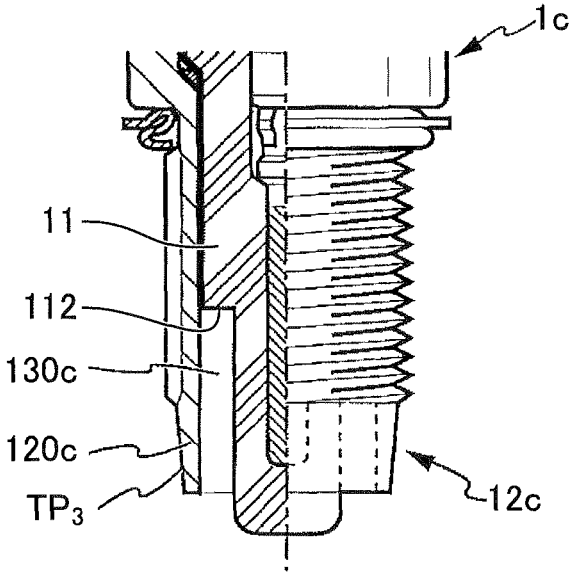
FIG. 7C is a cross section showing a part of an ignition device 1*c* as a third modification of the ignition device 1 according to the exemplary embodiment of the present invention.

FIG. 7C is a cross section showing a part of an ignition device is as a third modification of the ignition device 1 according to the exemplary embodiment.

In the structure of the ignition device 1*c* as the third modification of the embodiment shown in FIG. 7C, an outer peripheral surface of the front section of the ground electrode 120*c* has a tapered surface $TP_3$ so that a diameter of the front end section of the ground electrode 120*c* is gradually decreased to the top of the front end section of the ground electrode 120*c*. This structure makes it possible to guide, along a specified direction, fuel gas in the combustion chamber 51 of the cylinder head 50, which is flowing around the front end section 120*c* of the ground electrode. This makes it possible to quickly mix the generated flame kernel and fuel mixture gas. As a result, it is possible to achieve a rapid growth of the generated flame kernel.

Figure 7D:
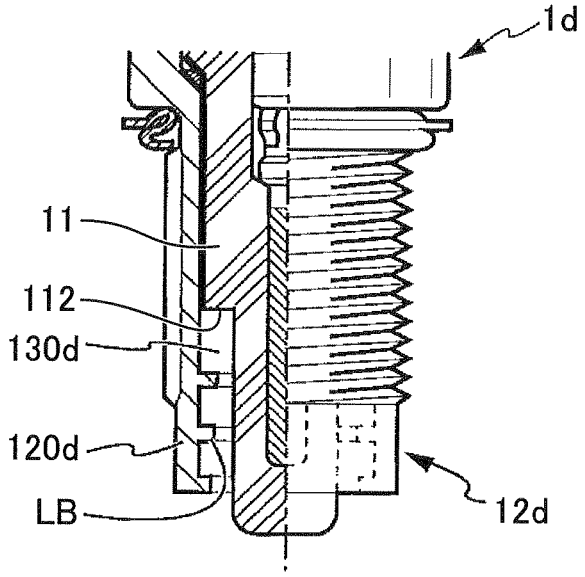
FIG. 7D is a cross section showing a part of an ignition device 1*d* as a fourth modification of the ignition device 1 according to the exemplary embodiment of the present invention.

FIG. 7D is a cross section showing a part of an ignition device 1*d* as a fourth modification of the ignition device 1 according to the exemplary embodiment.

In the structure of the ignition device 1*d* as the fourth modification of the embodiment shown in FIG. 7D, one or more projection sections LB are formed in the inner wall surface of the discharge chamber 130*d*. That is, each of the projection parts LB is formed on the inner wall surface of the discharge chamber 130*d* so that each projection parts LB project toward the inside of the discharge chamber 130*d*. This structure makes it possible to concentrate electric fields at the top of each projection parts LB, and to increase energy efficiency when flame kernel is generated in the discharge chamber 130*d*.

Figure 7E:
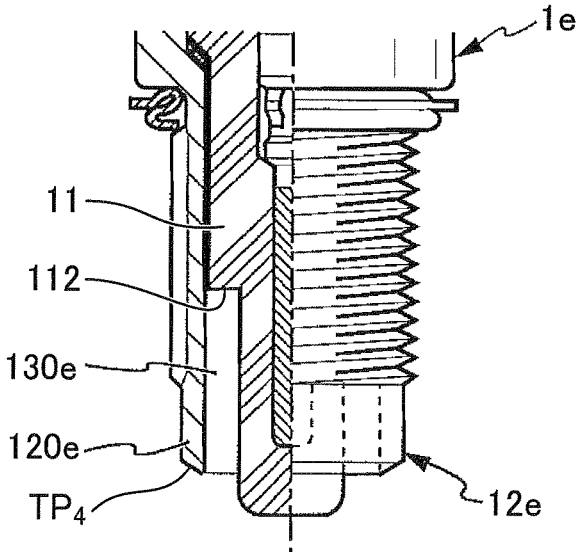
FIG. 7E is a cross section showing a part of an ignition device 1*e* as a fifth modification of the ignition device 1 according to the exemplary embodiment of the present invention.

FIG. 7E is a cross section showing a part of an ignition device 1*e* as a fifth modification of the ignition device 1 according to the exemplary embodiment.

In the structure of the ignition device 1*e* as the fifth modification of the embodiment shown in FIG. 7E, a tapered surface $TP_4$ is formed at a top surface, i.e., the front edge part of the front end section 120*e* of the ground electrode. A diameter of the tapered surface $TP_4$ is gradually decreased from the base part to the top part of the front edge of the front end section of the ground electrode 120*e*. This structure makes it possible to easily concentrate electric fields at the front edge of the front end section of the ground electrode 120*e*, and to generate flame kernel at the front edge part of the ground electrode where fresh air is supplied into the combustion chamber 51 of the cylinder head 50. As a result, it is possible to achieve a rapid growth of the generated flame kernel.

Figure 7F:
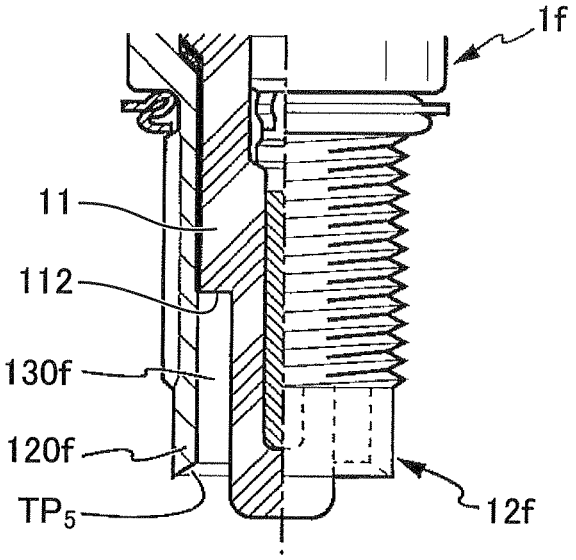
FIG. 7F is a cross section showing a part of an ignition device 1*f* as a sixth modification of the ignition device 1 according to the exemplary embodiment of the present invention.

FIG. 7F is a cross section showing a part of an ignition device 1*f* as a sixth modification of the ignition device 1 according to the exemplary embodiment.

In the structure of the ignition device 1*f* as the sixth modification of the embodiment shown in FIG. 7F, a tapered surface $TP_5$ is formed in the inner side of the front end section of the ground electrode 120*f*. A diameter of the tapered surface $TP_5$ is gradually decreased to the top section of the front end section of the ground electrode 120*f*.

This structure makes it possible to easily concentrate electric fields at the edge of the front end section of the ground electrode 120*f*. In addition to this feature, it is possible to easily introduce fuel gas mixture in the combustion chamber of the cylinder head into the inside of the discharge chamber 130*f*, and to generate flame kernel in the area where fresh air is supplied into the combustion chamber of the cylinder to head. As a result, it is possible to achieve a rapid growth of the generated flame kernel.

It is possible to select the ignition devices 1, 1*a*, 1*b*, 1*c*, 1*d*, 1*e* and 1*f* on the basis of various conditions of an internal combustion engine which uses the ignition device, for example, a flow of fuel gas in is a cylinder, a mount position to which the ignition device is mounted, a bore diameter internal combustion engine which uses the ignition device, etc.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. An ignition device mountable to an internal combustion engine having a combustion chamber in which fuel gas flow is generated, comprising:

a central electrode having an elongated shape;

a central dielectric body having a cylindrical shape with a base section which covers the central electrode;

a housing casing having a cylindrical shape which covers the central dielectric body;

a ground electrode having a ring shape formed at a front section of the housing casing, the ground electrode being electrically insulated from the central electrode by the central dielectric body, and the ground electrode being projected into an inside of the combustion chamber of the internal combustion engine by a predetermined height $H_{120}$, and a front end section of the central dielectric body being projected into the inside of the combustion chamber of the internal combustion engine by a predetermined height $H_{110}$ which is equal or greater than the predetermined height $H_{120}$ of the ground electrode;

a high frequency power source configured to supply for a predetermined period of time a high voltage having a predetermined frequency between the central electrode and the front end section of the ground electrode; and a discharge chamber having approximately a cylindrical shape formed between the central dielectric body and the ground electrode, the discharge chamber having a base section formed by at least a part of the central dielectric body, and a streamer discharge being executed in the discharge chamber in order to generate non-equilibrium plasma, react the generated non-equilibrium plasma with fuel mixture gas in the in the discharge chamber, and to ignite the fuel gas in the combustion chamber of the internal combustion engine.

2. The ignition device mountable to an internal combustion engine having a combustion chamber according to claim 1, wherein a conductive layer is formed within a predetermined area on a surface of the central dielectric body in order to adhere the central dielectric body to the housing casing by using elasticity of the conductive layer.

3. The ignition device mountable to an internal combustion engine having a combustion chamber according to claim 2, wherein the conductive layer is a layer formed by one of a conductive film printing, a plating, a metal foil pasting, a chemical vapor deposition, and a physical vapor deposition.

4. The ignition device mountable to an internal combustion engine having a combustion chamber according to claim 1, wherein the central dielectric body is made of at least nickel alloy and copper as a highly conductive material.

5. The ignition device mountable to an internal combustion engine having a combustion chamber according to claim 1, wherein the ground electrode has a height $H_{120}$ which is a distance between a ceiling inner wall of the combustion chamber of a cylinder head section of the internal combustion engine and a top surface of the front end section of the ground electrode, and the front end section of the central dielectric body has a height $H_{110}$ which is a distance between the ceiling inner wall of the combustion chamber of the cylinder head section and a top surface of the front end section of the central dielectric body, and the height $H_{120}$ of the front end section of the ground electrode is within a range of 3 mm to 25 mm.

6. The ignition device mountable to an internal combustion engine having a combustion chamber according to claim 1, wherein a height $H_{110}$ of the front end section of the central dielectric body is determined so that a distance $D_{GP1}$ is more than a distance $D_{GP2}$, where the height $H_{110}$ indicates a distance between a ceiling inner wall of the combustion chamber of the cylinder head section and a top surface of the front end section of the central dielectric body, the distance $D_{GP1}$ is measured from a top surface of the front end section of the central dielectric body and a top surface of the piston in the cylinder head at a top dead center, and the distance $D_{GP2}$ is measured from the top surface of the front end section of the central dielectric body and the front end section of the ground electrode, and the distance $D_{GP2}$ is expressed by an equation of $D_{GP2}=(\phi ID_{120}-\phi ID_{110})/2$, where $\phi ID_{120}$ indicates an inner diameter of the ground electrode, and $\phi ID_{110}$ indicates an outer diameter of the central dielectric body.

7. The ignition device mountable to an internal combustion engine having a combustion chamber according to claim 1, wherein a length $L_{130}$ of the discharge chamber is not more than 10 mm, where the length $L_{130}$ of the discharge chamber is determined from the front end section of the ground electrode to the base section of the discharge chamber.

8. The ignition device mountable to an internal combustion engine having a combustion chamber according to claim 1, wherein a top surface of the front end section of the central dielectric body has a flat shape, and an outer periphery of the front end section of the central dielectric body has a rounded shape.

9. The ignition device mountable to an internal combustion engine having a combustion chamber according to claim 1, wherein the high frequency power source supplies for a predetermined period of time a high voltage having a predetermined frequency within a range of 15 kHz to 50 MHz between the central electrode and the front end section of the ground electrode.

10. The ignition device mountable to an internal combustion engine having a combustion chamber according to claim 1, wherein the discharge chamber has an inclined plane, a diameter of the discharge chamber is gradually increased from the base section to the front section of the discharge chamber, and a cross sectional area of the discharge chamber is gradually increased from the base section to the front section of the discharge chamber.

11. The ignition device mountable to an internal combustion engine having a combustion chamber according to claim 1, wherein the discharge chamber has a tapered surface, a diameter of the discharge chamber is gradually decreased from the base section to the front section of the discharge chamber, and a cross sectional area of the discharge chamber is gradually decreased from the base section to the front section of the discharge chamber.

12. The ignition device mountable to an internal combustion engine having a combustion chamber according to claim 1, wherein the discharge chamber has an outer peripheral surface of the front section of the ground electrode has a tapered surface so that a diameter of the front end section of the ground electrode is gradually decreased to a top of the front end section of the ground electrode.

13. The ignition device mountable to an internal combustion engine having a combustion chamber according to claim 1, wherein a plurality of projection sections is formed on an inner wall surface of the discharge chamber.

14. The ignition device mountable to an internal combustion engine having a combustion chamber according to claim 1, wherein the discharge chamber has a tapered surface formed at a top surface of the front end section of the ground electrode, and a diameter of the tapered surface is gradually decreased from a base part to a top part of the front edge part of the front end section of the ground electrode.

15. The ignition device mountable to an internal combustion engine having a combustion chamber according to claim 1, wherein the discharge chamber has a tapered surface formed in an inner side of the front end section of the ground electrode, and a diameter of the tapered surface is gradually decreased to a top section of the front end section of the ground electrode.

16. The ignition device mountable to an internal combustion engine having a combustion chamber according to claim 1, wherein the base section is formed by the central dielectric body in a direction which is perpendicular to a longitudinal axis of the central electrode.

* * * * *